United States Patent [19]

Breining et al.

[11] Patent Number: 4,672,234

[45] Date of Patent: Jun. 9, 1987

[54] SWITCH SYSTEM FOR OVERHEAD ELECTRIC CORDS

[75] Inventors: Frank E. Breining, Jackson, Mich.; Dwight C. Janisse, St. Clair Beach, Canada

[73] Assignee: Airmaster Fan Company, Jackson, Mich.

[21] Appl. No.: 790,498

[22] Filed: Oct. 23, 1985

[51] Int. Cl.[4] ..... H01H 9/00

[52] U.S. Cl. ..... 307/147; 307/112; 307/114; 307/125; 307/134

[58] Field of Search ..... 307/112, 114, 125, 134, 307/140, 141.8, 147, 149, 154; 339/28; 200/51 R, 51.02, 51 LM, 51.13, 51.14

[56] References Cited

U.S. PATENT DOCUMENTS

| | | | |
|---|---|---|---|
| 2,484,092 | 10/1949 | Hopgood | 171/97 |
| 2,565,075 | 8/1951 | Harcharek | 173/334 |
| 2,707,754 | 5/1955 | Ludwig | 307/112 |
| 2,752,582 | 6/1956 | Cargill | 339/155 |
| 2,798,172 | 7/1957 | Jones | 307/147 |
| 2,979,624 | 4/1961 | Askerneese | 307/38 |
| 3,334,250 | 8/1967 | Gwin, Jr. | 307/114 |
| 3,514,626 | 5/1970 | Platzer, Jr. | 307/114 |
| 3,534,319 | 10/1970 | Queirolo et al. | 339/28 R X |
| 4,357,506 | 11/1982 | Breining | 307/112 X |

FOREIGN PATENT DOCUMENTS

| | | | |
|---|---|---|---|
| 0618701 | 2/1949 | United Kingdom | 307/147 |

OTHER PUBLICATIONS

"RELOC-A New Concept in Flexible Wiring", RELOX Company, Jan. 1977.

*Primary Examiner*—William M. Shoop, Jr.
*Assistant Examiner*—Bentsu Ro
*Attorney, Agent, or Firm*—Beaman & Beaman

[57] ABSTRACT

A switch system for overhead electric extension cords for remotely controlling overhead-mounted electrical appliances, such as fans. A drop cord includes an upper end having electrical fittings connectable to an overhead power supply extension cord and the electric user cord, and the lower end of the drop cord includes a switch at an accessible level from the floor. The drop cord switch controls the circuit between the power supply and user cords, and a strain relief cable anchored overhead supports the weight of the switch.

3 Claims, 6 Drawing Figures

SWITCH SYSTEM FOR OVERHEAD ELECTRIC CORDScl BACKGROUND OF THE INVENTION

Air circulation fans, and other electric appliances, are often mounted at overhead locations for efficiency and clearance purposes. Such overhead installations are particularly common in industrial environments such as factories and garages wherein the appliance may be located between ten and twenty feet above the floor level. While some overhead appliances include pull cord switches, the pull cords of such switches may not be of sufficient length to be accessible from the floor and pull cords of a length greater than a few feet are undesirable, and difficulty is encountered in controlling overhead-mounted fans, lights and the like wherein permanent switch-controlled circuits are not installed or are not available. Commonly, such overhead installations utilize flexible extension cords to provide electric power to the appliance, and control of the appliance is often achieved by plugging and unplugging the extension cord if the cord is associated with an accessible electrical outlet.

Remotely-controlled switch-operated circuits for extension cord systems are known, and typical examples of such devices are shown in U.S. Pat. Nos. 2,484,092; 2,752,582; 2,979,624 and 3,334,250. However, such known devices are usually adapted for use with appliances accessible from the floor, and such devices are usually directly associated with electrical outlets. Such known patents are not readily employed with overhead extension cord systems.

An object of the invention is to provide a switch system for extension cords located overhead and remote from the floor level.

A further object of the invention is to provide a switch system for flexible extension cords located overhead wherein the switch system circuit may be readily interposed within an extension cord system without requiring modification thereto.

Yet another object of the invention is to provide a switch system for extension cords located overhead including a drop cord having a lower end supporting a switch accessible from the floor wherein a strain relief cable is employed to support the weight of the drop cord switch.

In the practice of the invention an overhead electric appliance, such as a fan, is connected to an electric power source by a flexible extension cord. Intermediate the extension cord connected to the power supply and the cord connected to the appliance, a switch system is interposed. The extension cord is connected to the switch system and the appliance cord is also connected thereto, and the switch system includes a switch accessible from the floor level which controls the circuit between the extension cord and the appliance.

More particularly, the switch system consists of a drop cord having an upper end of a T configuration. At each end of the T cross bar, an electrical connection fitting is mounted. The extension cord is plugged into one fitting, while the appliance cord is plugged into the other. A switch is located at the lower end of the drop cord, and the electricl conductors within the cross bar directly connect the neutral wire of the extension cord to the neutral wire of the appliance cord, while other conductors within the cross bar and drop cord are connected to the energized extension cord conductor and the positive conductor of the applicance through the switch. Thus, as the switch is opened and closed, the circuit through the energized conductor is completed and interrupted, controlling operation of the appliance.

Preferably, the extension cord, appliance cord and drop cord also include a ground conductor associated with the fittings and the switch housing to protect the user.

To alleviate the weight of the switch housing from being interposed upon the drop cord a strain relief cable is attached to the switch housing having an upper end mounted to an anchor located above the switch wherein the strain relief cable supports the weight of the lower portion of the drop cord and the switch housing and minimizes the likelihood of damage to the drop cord.

Installation of a switch system in accord with the invention requires only that the extension cord and appliance cord be plugged into the drop cord fittings and the strain relief cable anchored as desired. No modifications to the extension or appliance cords are required, and the invention pertains to a switch system which may be easily installed into an overhead appliance electrical circuit.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENT

Figures 1, 2, 3, 4, 5, 6:
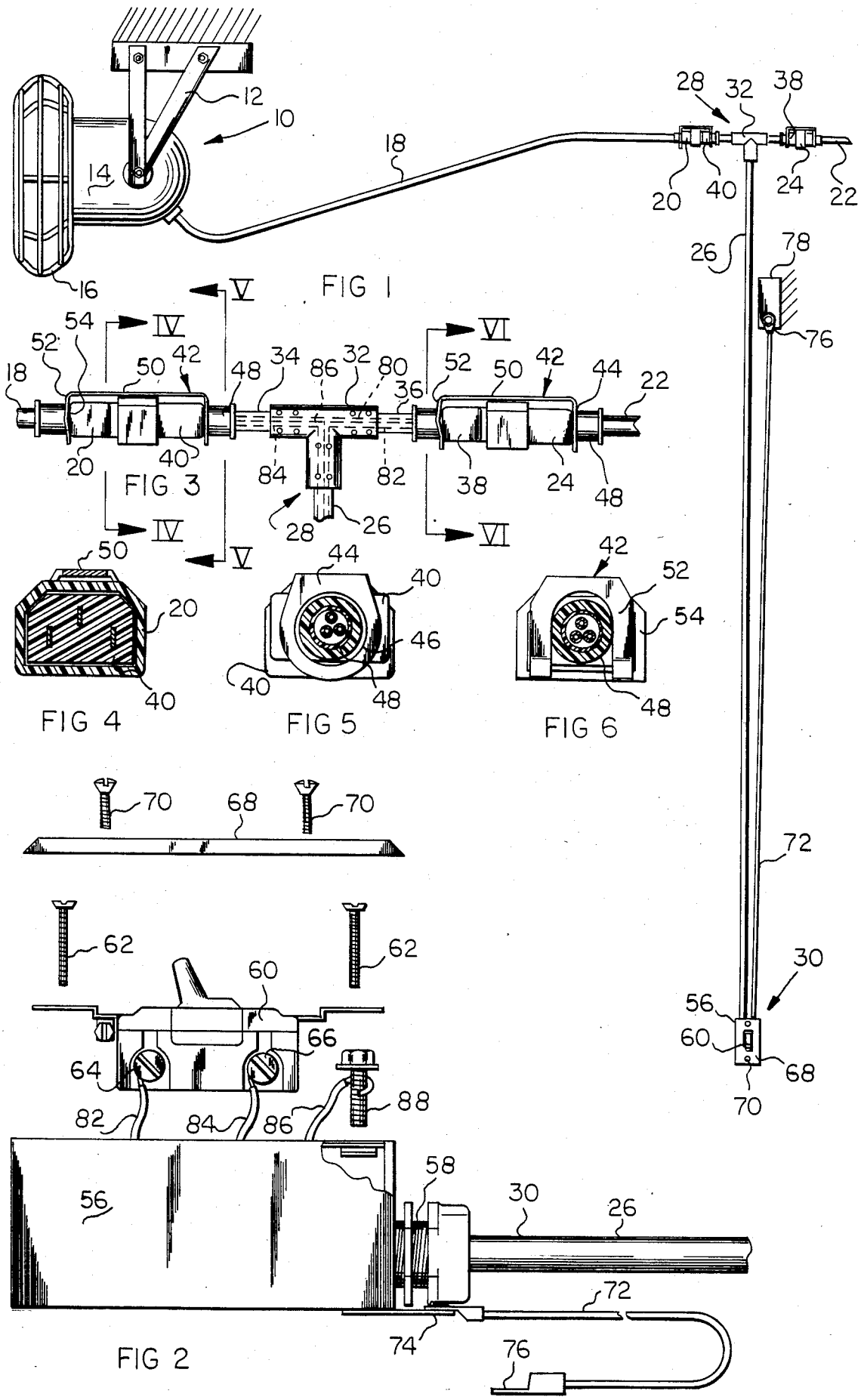
FIG. 1 is an elevational view of a typical installation of a switch system in accord with the invention.
FIG. 2 is an enlarged, detail, elevational, exploded view of the lower end of the drop cord switch housing shown in horizontal orientation.
FIG. 3 is a detail, elevational view of the drop cord upper cross bar end as connected to an extension cord and appliance cord, the conductors being schematically shown by dotted lines.
FIG. 4 is an elevational, sectional view taken through a fitting along Section IV—IV of FIG. 3.
FIG. 5 is an elevational, sectional view as taken along Section V—V of FIG. 3.
FIG. 6 is an elevational, sectional view as taken along Section VI—VI of FIG. 3.

As shown in FIG. 1, an electric fan 10 is mounted at an overhead location upon a bracket 12. The fan 10 includes a motor 14 and a blade screen guard 16. An electrical cord 18 is connected to the motor and terminates in a jacketed three prong male fitting 20 commercially available, such as a J. Phillip Connector Model No. JP-3BME-HD.

A flexible extension cord 22, FIG. 1, has a remote end, not shown, plugged into an electrical supply receptacle wherein the extension cord 22 constitutes the electrical supply for the fan circuit system. The end of the extension cord 22 is provided with a female three terminal connector fitting 24, such as a J. Phillip Connector Model No. JP-3BME. In a system not utilizing the switch circuitry of the invention, the fitting 20 may be plugged into the fitting 24 for energizing the fan. However, such an arrangement provides no switch control of the fan 10 as the fan, cord 18 and extension cord 22 are located at an elevated position, usually in excess of ten feet above the floor, and with such an arrangement, energization of the fan is usually controlled by manually plugging or unplugging the extension cord male fitting, not shown, into the electrical wall receptacle, not shown, if the wall receptable is readily accessible.

In accord with the invention the switching system includes a drop cord of a T-configuration which is interposed between the appliance cord 18 and the extension cord 22. The drop cord is generally indicated at 26 and includes the upper end 28, and a lower end 30 and the length of the drop cord will normally be in the neighborhood of fourteen or fifteen feet. Of course, the length of the drop cord may vary in accord with the installation with which it is used, but a typical length would be approximately fifteen feet.

At its upper end 28 the drop cord is of a T-configuration wherein a molded plastic tee 32 receives the cords 34, and 36, FIG. 3. The cord 36 has at its outer end a male fitting 38 identical to fitting 20 for connection with the three terminal female fitting 24 and the cord 34, at its outer end, is provided with the female fitting 40 which is identical to fitting 24 for receiving the three prongs of the fitting 20 attached to the end of the fan cord 18. It will be appreciated that the associated fittings 20 and 40, and 24 and 38 will be readily connected and disconnected by relative displacement in an axial direction. Inadvertent separation of the associated fittings is prevented by sheet metal retainer clips as will be apparent from FIGS. 3, 5 and 6.

The retainer clips 42 are mounted upon the fittings 24 and 40 and each include an end 44 having an opening 46 defined therein circumscribing the associated fitting cylindrical portion 48. The retainer clips also include an axially extending portion 50, and at the outer end are provided with a U-shaped end 52 forming a yoke which snaps over the shoulders 54 of the associated fitting 20 and 38 as apparent in FIGS. 3 and 6. When the retaining clips 42 are in the relationship shown in FIG. 3, the fittings 20 and 40, and 24 and 38, cannot be inadvertently disconnected by an axial force as the retainers will prevent separation of the interconnected fittings. By raising the retainer clip end 52 from the associated fitting shoulder by a transverse force, the clip may be removed from the fittings 20 or 38, and the associated fittings disconnected. At its lower end 30, the drop cord 26 is provided with a conventional box-like switch housing 56. The switch housing includes a threaded entrance stud and grommet assembly 58, FIG. 2, wherein the lower end of the cord is received within the switch housing. A conventional switch 60 is mounted within the housing 56 by screws 62, and the switch includes screw terminals 64 and 66. A face plate 68 is attachable to the switch by screws 70, in the known manner, and as will be appreciated, the switch housing 56, switch 60 and face plate 68 are of conventional construction as commercially available.

A strain relief cable 72 has a lower end 74 which is affixed to the switch housing 56, and the upper end of the strain relief cable includes an eye 76 for attachment to an anchor 78 located above the switch housing when the drop cord is installed. The length of the strain relief cable 72 is normally slightly less than the length of the drop cord 26, and the location of the anchor 78 is such that the weight of the cord 26 and switch housing 56 is borne by the cable 72 and not the drop cord and the cords 18 and 22.

Preferably, the entire circuit system is of the three wire ground type. For this reason each of the fittings 20, 24, 38 and 40 has three terminals, as will be appreciated from FIG. 4. As represented in dotted lines in FIG. 3, a terminal in fitting 38 is connected to a terminal in fitting 40 by neutral conductor wire 80. A conductor wire 82 within fitting 38 is connected to the energized terminal of the fitting 24, and this conductor extends through the drop cord 26 to the switch terminal 64. A second conductor wire 84 within the cord 26 is connected to the other switch terminal 66 which is connected to a terminal within the fitting 40. The ground conductor 86 is attached to the central terminal of the fittings 38 and 40, and the ground conductor within cord 26 is connected to the switch housing ground bolt 88, FIG. 2, at its lower end to ground the switch housing.

To use the switch system of the invention it is only necessary to connect the extension cord fitting 24 to the drop cord fitting 38, and the fan cord fitting 20 to the drop cord fitting 40. The retainer clips 42 may then be snapped into their effective locking position as shown in FIG. 3, and in this manner the T cross bar of the drop cord upper end 28 is installed in the circuit between the extension cord 22 and the fan cord 18.

The upper end eye 76 of the strain relief cable 72 is attached to a suitable anchor 78 for supporting the weight of the drop cord and switch housing. The drop cord 26 may be located as desired for the most convenience, and it may be desirable for the switch housing 56 to be located adjacent a wall or partition, or the switch housing may be suspended in such a manner as to be located adjacent a work station, or the like.

As the energized conductor 82 of the extension cord 22 is connected to the switch 60 operation of the switch will control the energized side of the circuit to the fan and safely regulate fan operation.

It will be appreciated that a switch system in accord with the invention may be quickly installed in a system having compatible fittings and permits extension cord type electrical supply systems to be provided with a remotely-controlled switch without modification to the circuit. Of course, a wide variety of fittings may be used with the fan cord, extension cord and drop cord. It is only necessary that the male and female fittings be compatible. The disclosed switching system prevents undue tension forces being imposed upon the extension or fan cord, and the use of the strain relief cable minimizes the likelihood of damage to the cords of the system.

It is appreciated that various modifications to the inventive concepts may be apparent to those skilled in the art without departing from the spirit and scope of the invention.

We claim:

1. A switch system for flexible overhead electric cords each having at least two conductors, the cords including a power extension cord connected to an electric power source having a power supply fitting having plug-in terminals and a shoulder and a user cord connected to an electric power user having a user fitting having plug-in terminals and a shoulder comprising, in combination, a flexible drop cord having a lower end and an upper end, a first fitting defined on said drop cord upper end having plug-in terminals and releasably connectable to the extension cord power supply fitting terminals, a second fitting defined on said drop cord upper end having plug-in terminals releasably connectable to the user cord fitting terminals, said drop cord upper end comprising a T-configuration having a cross bar having ends, said first fitting being mounted upon one of said cross bar ends and said second fitting being mounted upon the other cross bar end, electric switch means affixed to said drop cord lower end having a pair of terminals, said switch means including housing, a switch mounted within said housing, said switch means terminals being defined on said switch, shoulders defined upon said first and second fittings, releasable fitting retainers mounted exteriorly of said first and second fittings interposed between the shoulders of said first fitting and the power supply fitting and the shoulders of said second fitting and the user fitting, respectively, to prevent inadvertent unplugging of the associated plug-in fittings, a first conductor within said drop cord upper end directly connecting a terminal of said first fitting with a terminal of said second fitting, a second conductor within said drop cord connecting a terminal of said first fitting with one of said switch means terminals, and a third conductor within said drop cord connecting a terminal of said second fitting with the other of said switch means terminals whereby connection of the power supply fitting to said first fitting and connection of the user fitting with said second fitting permits said switch means to control the electrical circuit to the electric power user.

2. In a switch system for electric cords as in claim 1, a flexible, elongated, strain relief member having a lower end attached to said switch means housing and an upper end for attachment to support means located vertically above said switch means housing.

3. In a switch system for electric cords as in claim 1, a flexible ground conductor connecting a terminal of said first fitting with a terminal of said second fitting and with said switch means.

* * * * *